US011478051B1

(12) United States Patent
Robinson

(10) Patent No.: US 11,478,051 B1
(45) Date of Patent: Oct. 25, 2022

(54) AUTOMATIC LATCH FOR A TWO-PIECE CONTAINER

(71) Applicant: Gary Lee Robinson, Saint Charles, MO (US)

(72) Inventor: Gary Lee Robinson, Saint Charles, MO (US)

( * ) Notice: Subject to any disclaimer, the term of this patent is extended or adjusted under 35 U.S.C. 154(b) by 0 days.

(21) Appl. No.: 17/648,354

(22) Filed: Jan. 19, 2022

Related U.S. Application Data

(60) Provisional application No. 63/201,984, filed on May 21, 2021.

(51) Int. Cl.
*A44B 13/02* (2006.01)
*A45C 13/10* (2006.01)
(Continued)

(52) U.S. Cl.
CPC ..... *A44B 13/02* (2013.01); *A44B 11/2511* (2013.01); *A45C 13/1084* (2013.01);
(Continued)

(58) Field of Classification Search
CPC ..... Y10T 292/0926; Y10T 292/0911; Y10T 292/0928; Y10T 292/0934; Y10T 292/0945; Y10T 292/0951; Y10T 292/0952; Y10T 292/0953; Y10T 292/0959; Y10T 292/1043; Y10T 292/1051; Y10T 292/1061; Y10T 292/1075; Y10T 292/1083; Y10T 292/1084; Y10T 292/1085; Y10T 292/1092; Y10T 292/696; Y10T 292/702; A44B 13/02; A44B 11/2507; A44B 11/2511; A44B 11/2526; A45C 13/1084; E05C 3/045; E05C 3/00; E05C 3/006;
(Continued)

(56) References Cited

U.S. PATENT DOCUMENTS 274,497 A * 3/1883 Judson ..... E05C 17/50 292/121
512,517 A * 1/1894 Ottenheimer ..... E05C 19/06 217/56
(Continued)

FOREIGN PATENT DOCUMENTS

FR 1384767 A * 11/1963 ..... A45C 13/1084
GB 2097056 A * 10/1982 ..... E05B 65/0014

*Primary Examiner* — Kristina R Fulton
*Assistant Examiner* — Steven A Tullia
(74) *Attorney, Agent, or Firm* — Dunlap Bennett & Ludwig, PLLC

(57) ABSTRACT

A self-locking latch assembly for a two-piece container is provided. The latch assembly has a latch hook pivotably biased in a parallel orientation to the first piece of the two-piece container, while a keeper is connected though spaced apart from the surface of the second piece of the two-piece container. The two-piece container is adapted to move between an open and closed position by sliding an open end of the larger piece over an open end of a smaller piece. During this sliding action, toward the closed position, a tapered edge of the latch hook strikes the keeper and is urged upward until the tapered edge ends, whereby the biasing of the latch hook urges it to engage the keeper in a locked condition. To unlock the latch hook, one can pivot it to a nonparallel orientation and slide the two pieces apart.

18 Claims, 5 Drawing Sheets

(51) Int. Cl.
*E05C 3/04* (2006.01)
*E05C 3/30* (2006.01)
*A44B 11/25* (2006.01)
*E05C 3/14* (2006.01)

(52) U.S. Cl.
CPC ..... *E05C 3/045* (2013.01); *E05C 3/14* (2013.01); *E05C 3/30* (2013.01)

(58) Field of Classification Search
CPC . E05C 3/008; E05C 3/12; E05C 3/124; E05C 3/14; E05C 3/22; E05C 3/24; E05C 3/26; E05C 3/30; E05C 3/40; E05C 3/04; E05C 3/047; E05C 3/048; Y10S 292/11; Y10S 292/30; Y10S 292/37; Y10S 292/42; Y10S 292/50; Y10S 292/63
See application file for complete search history.

(56) References Cited

U.S. PATENT DOCUMENTS 1,015,455 A * 1/1912 Neesham ..... B65D 21/086 206/541
1,016,422 A * 2/1912 Lauritsen ..... E05C 17/50 292/121
1,395,627 A * 11/1921 Binkley ..... E05C 19/06 24/640
1,552,132 A * 9/1925 Frasch ..... E05C 17/50 292/126
1,639,878 A * 8/1927 Bentrott ..... E05B 65/0835 292/DIG. 46
2,541,890 A * 2/1951 Schaperkotter ..... A01K 97/06 292/108
2,794,664 A * 6/1957 Kruger ..... F21V 17/18 292/99
3,266,830 A * 8/1966 Appleberry ..... E05C 3/14 292/DIG. 31
4,261,605 A * 4/1981 Hock ..... E05C 3/14 292/228
4,953,773 A * 9/1990 Wirth ..... B60R 9/12 294/147
5,235,830 A * 8/1993 Benge ..... E05B 63/244 70/159
5,412,960 A * 5/1995 James ..... E05C 3/12 312/334.32
D392,801 S * 3/1998 Hields ..... E05B 35/008 D3/261
5,758,770 A 6/1998 Moneta
5,823,489 A 10/1998 Suk
5,829,591 A * 11/1998 Lyons ..... B65D 21/086 220/8
5,865,480 A * 2/1999 Bain, Jr ..... E05C 17/04 292/109
6,149,168 A 11/2000 Pauser et al.
6,349,578 B1 * 2/2002 Tuvy ..... E05B 35/008 292/121
6,409,065 B1 6/2002 Edgerly
6,729,489 B2 5/2004 Sanderson
6,942,257 B2 * 9/2005 Wong ..... E05B 65/0014 292/228
8,850,670 B2 * 10/2014 Fiedler ..... A63C 11/2224 280/821
9,151,081 B2 10/2015 Thomson
9,241,557 B2 1/2016 Abramowitz et al.
9,597,790 B2 * 3/2017 Moschella ..... B25H 3/02
10,118,083 B2 11/2018 Ford et al.
10,279,241 B1 5/2019 Lurie
10,492,578 B2 12/2019 Heim et al.
10,583,883 B2 3/2020 Visenzi
2003/0034654 A1 * 2/2003 Brewster ..... E05C 19/10 292/121
2008/0150301 A1 6/2008 Homner
2009/0194445 A1 8/2009 Mongan et al.
2011/0309730 A1 * 12/2011 Retchloff ..... E05C 3/14 292/210
2012/0234706 A1 9/2012 Underfer
2016/0215985 A1 * 7/2016 Blouin ..... E05C 3/14
2021/0274903 A1 9/2021 Bladd-Symms et al.

* cited by examiner

AUTOMATIC LATCH FOR A TWO-PIECE CONTAINER

CROSS-REFERENCE TO RELATED APPLICATION

This application claims the benefit of priority of U.S. provisional application No. 63/201,984, U.S. provisional application number filed 21 May 2021, the contents of which are herein incorporated by reference.

BACKGROUND OF THE INVENTION

The present invention relates to container locking mechanisms and, more particularly, an automatic latching system for two-piece containers that slide apart and together to safely contain objects therein.

Certain articles or items are preferably stored in two-piece containers that slide apart and together to safely contain objects therein. Sportube®, for instance, is one such two-piece container for skis. Understandably, the good condition and security of such contained articles are compromised if the two-piece container is not properly secured. When traveling by airplane, owners of articles contained in two-piece containers are at the mercy of the Transportation Security Administration (TSA). Specifically, when the TSA agent removes the pin or lock to inspect the contents of such two-piece containers, they may either not reinstall the pin or lock or may install them incorrectly (e.g., the security pin or lock is not engaged correctly); as a result, the two-piece container may inadvertently slide open during transport, possibly losing or damaging the articles. In other words, current solutions for securing two-piece containers rely on a random TSA inspector correctly reinstalling the securing device.

As can be seen, there is a need for an automatic latch for two-piece containers. The latch embodied in the present invention is adapted to automatically engage and secure when the two pieces of the two-piece containers are moved to their closed position. Thereby, the automatic latch of the present invention allows the two-piece container to be opened easily for inspection and then, when the two-piece container is closed, the automatic latch will self-engage, locking the two pieces together and keeping the contents secure for transport.

SUMMARY OF THE INVENTION

In one aspect of the present invention, a automatic latch system for a two-piece container slidably movable between a closed position and an open position, the automatic latch system includes: a latch hook pivotably biased in a parallel orientation to a first piece of the two-piece container, wherein a distal end of the latch hook protrudes beyond the first piece; a keeper connected to and spaced apart from a second piece of the two-piece container; and the distal end has a tapered edge for riding the keeper away from the first piece as the first and second pieces move toward the closed position.

In another aspect of the present invention, the automatic latch system further includes the following: a biasing element operatively associated with a proximal end of the latch hook and the first piece; and a pivot point of the latch hook between the biasing element and the distal end of the latch hook; a riser channel attached to the second piece for carrying the biasing element and pivot point; a mounting plate interconnecting the first piece and the riser channel, wherein a distal portion of the mounting plate protrudes beyond the first piece, and wherein the distal portion is bent toward the second piece, wherein a fin portion extends from the second piece, and wherein the keeper is connected directly or indirectly to the fin portion, wherein at least one fastener connecting the keeper to the fin portion, wherein a keeper is a shoulder bolt, and wherein the keeper rides the distal portion of the mounting plate as the first and second pieces move toward the closed position.

These and other features, aspects and advantages of the present invention will become better understood with reference to the following drawings, description and claims.

DETAILED DESCRIPTION OF THE INVENTION

Figure 1:
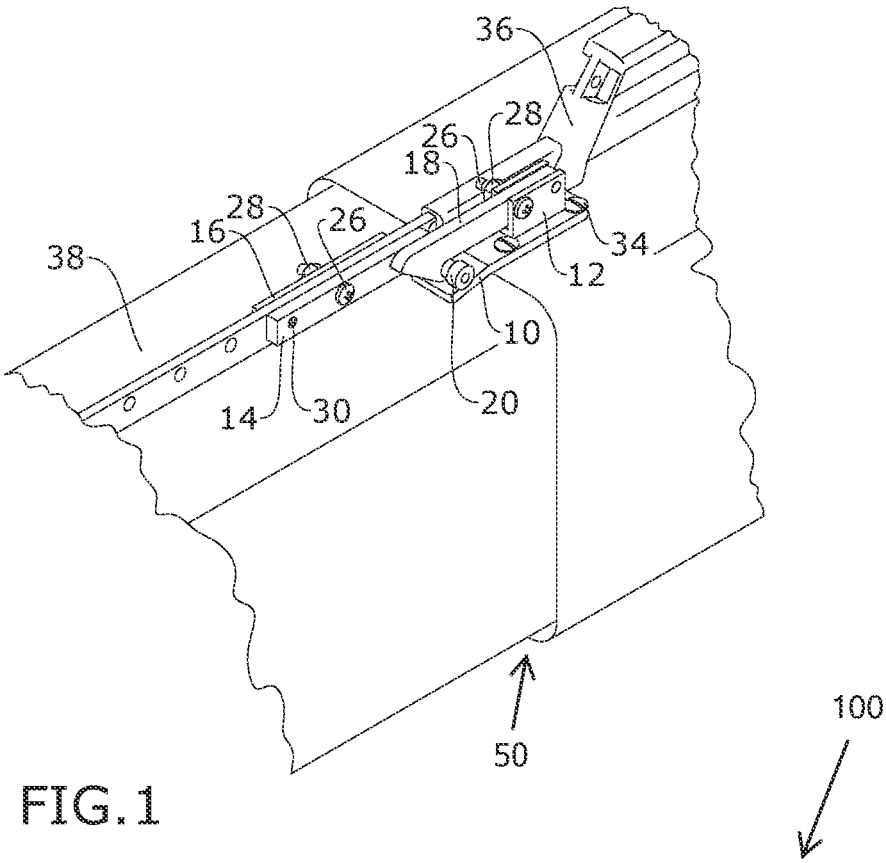
FIG. 1 is a perspective view of an exemplary embodiment of the present invention.
Figure 2:
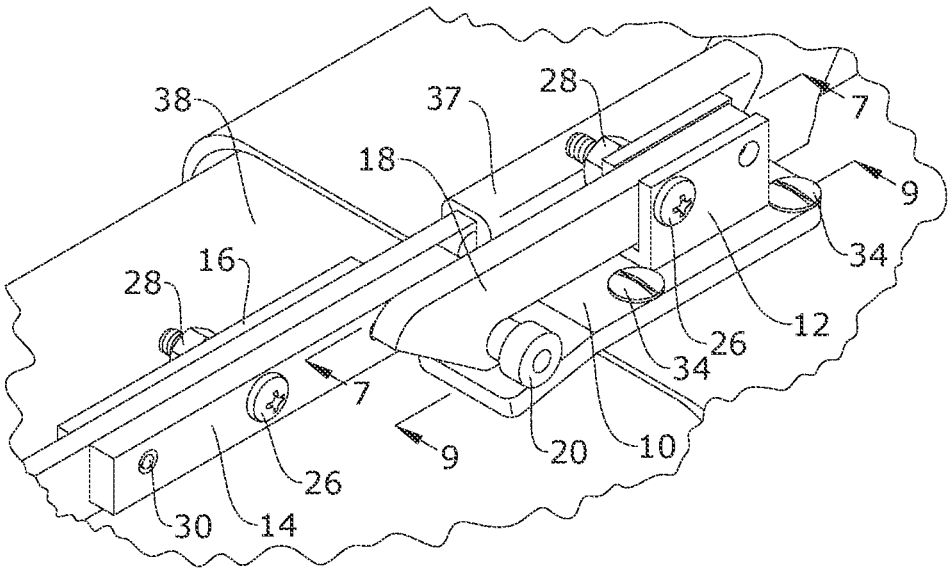
FIG. 2 is a detailed perspective view of an exemplary embodiment of the present invention.
Figure 3:
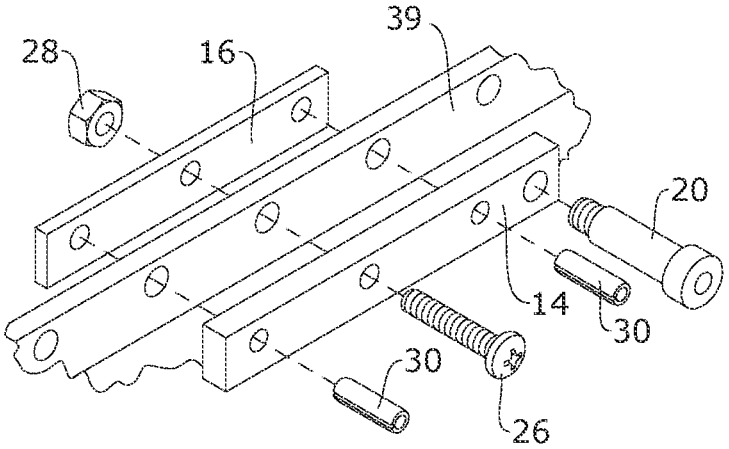
FIG. 3 is a detailed exploded perspective view of an exemplary embodiment of the present invention.
Figure 4:
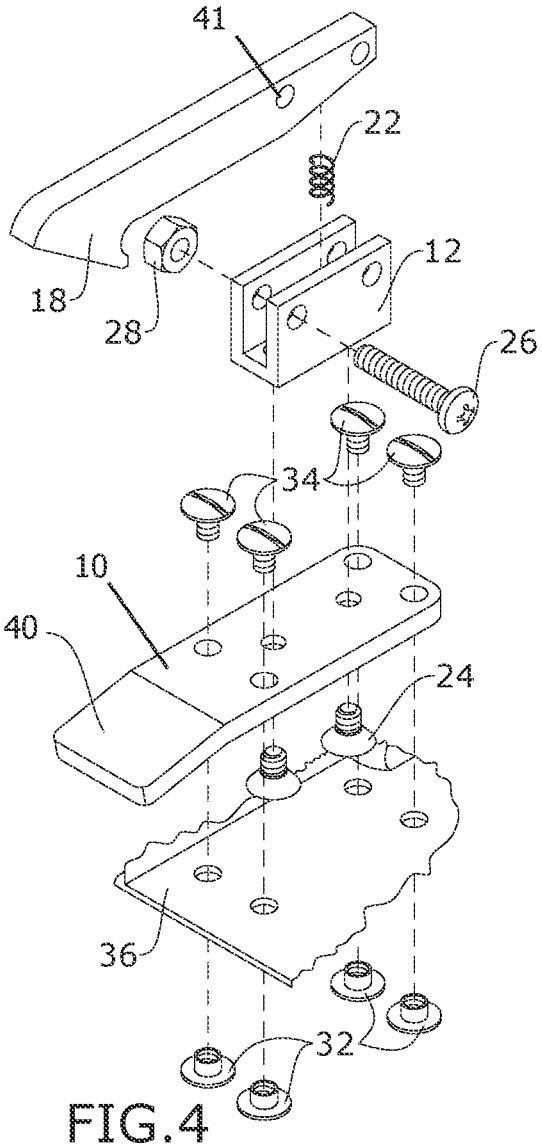
FIG. 4 is a detailed exploded perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a self-locking latch assembly for a two-piece container. The latch assembly has a latch hook pivotably biased in a parallel orientation to the first piece of the two-piece container, while a keeper is connected though spaced apart from the surface of the second piece of the two-piece container. The two-piece container is adapted to move between an open and closed position by sliding an open end of the larger piece over an open end of a smaller piece. During this sliding action, toward the closed position, a tapered edge of the latch hook strikes the keeper and is urged upward until the tapered edge ends, whereby the biasing of the latch hook urges it to engage the keeper in a locked condition. To unlock the latch hook, one can pivot it to a nonparallel orientation and slide the two pieces apart.

Referring now to FIGS. 1 through 11, the present invention may include a self-locking latch assembly 100 for a two-piece container operatively associated at the interface of a first piece 36 and a second piece 38 of a two-piece container 50 so that when the two pieces moves between an open condition and a closed condition the self-locking latch assembly 100 automatically moves from an unlocked-disengaged condition to a locked engaged condition.

The self-locking latch assembly 100 has a biased latch hook 18 and a locking pin 20 to and from which the former locks and unlocks. The biased latch hook 18 is associated with the first piece 36. The locking pin 20 is associated to the second piece 38. A distal end of the biased latch hook 18 engages (and disengages from) the locking pin 20. The distal end provides a hook portion for engaging the locking pin 20.

Figure 5:
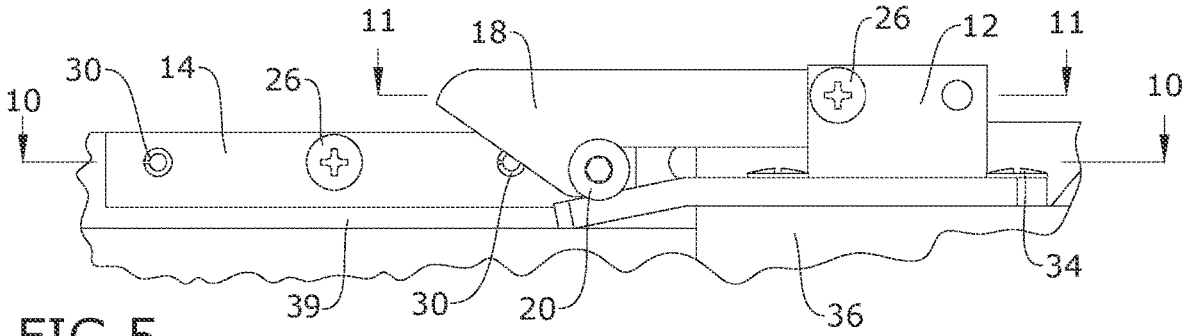
FIG. 5 is a detailed elevation view of an exemplary embodiment of a latch assembly of the present invention, shown in an engaged condition.
Figure 6:
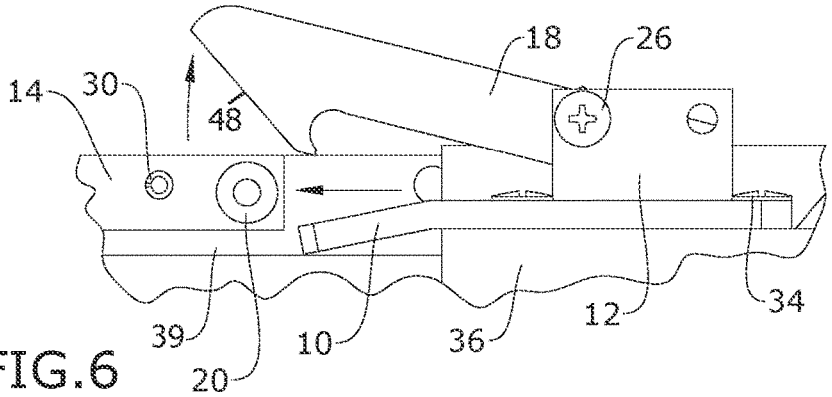
FIG. 6 is a detailed elevation view of an exemplary embodiment of the latch assembly of the present invention, shown in a disengaged condition.
Figure 7:
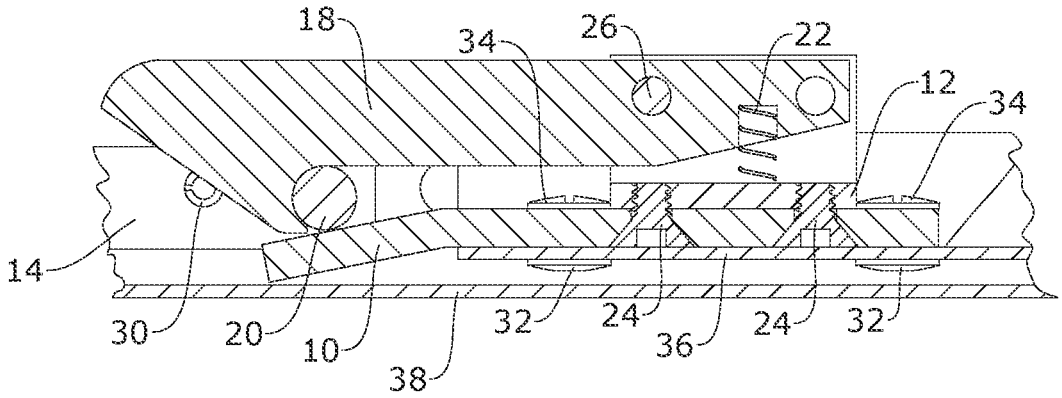
FIG. 7 is a section view of an exemplary embodiment of the present invention, taken along line 7-7 in FIG. 2.
Figure 8:
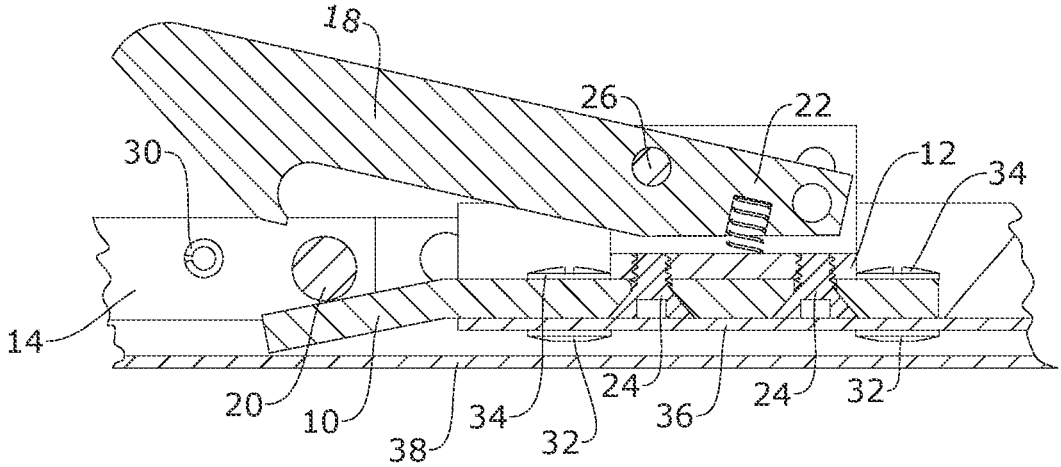
FIG. 8 is the section view of FIG. 7, showing the latch assembly of the present invention in the disengaged condition.
Figure 9:
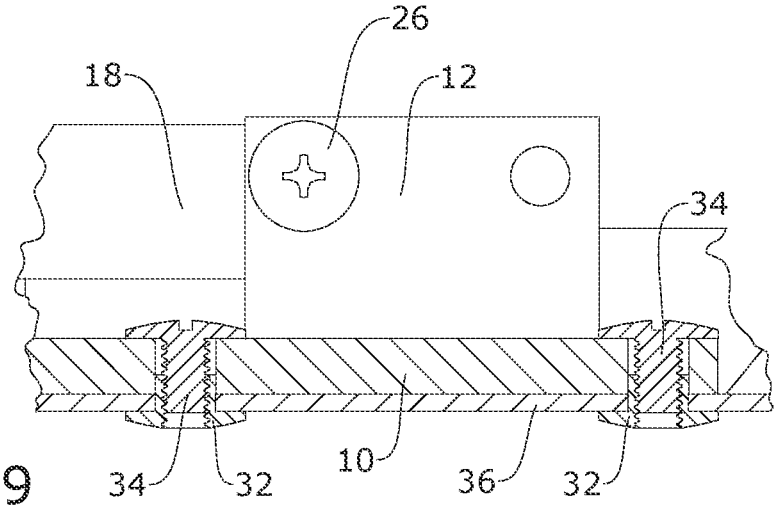
FIG. 9 is a section view of an exemplary embodiment of the present invention, taken along line 9-9 in FIG. 2.
Figure 10:
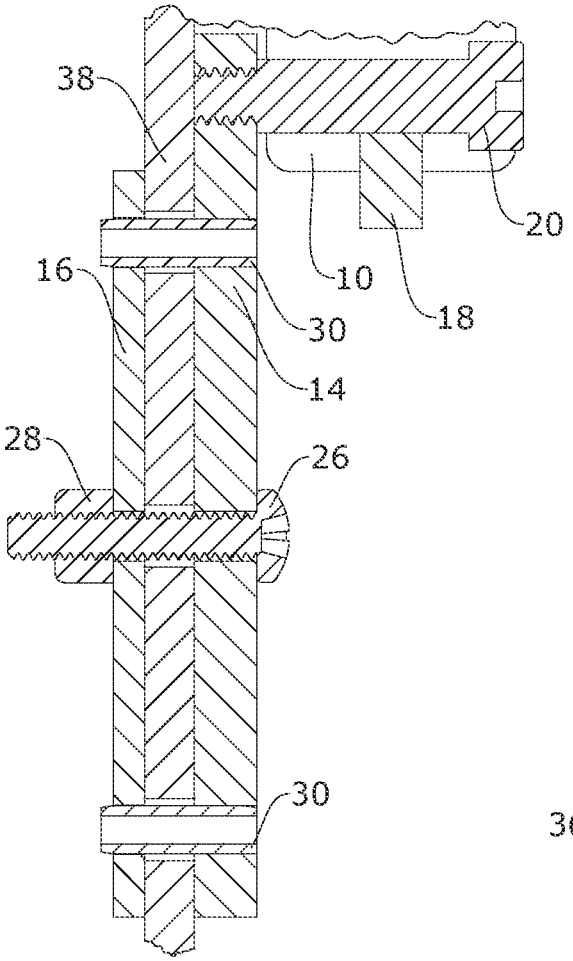
FIG. 10 is a section view of an exemplary embodiment of the present invention, taken along line 10-10 in FIG. 5.
Figure 11:
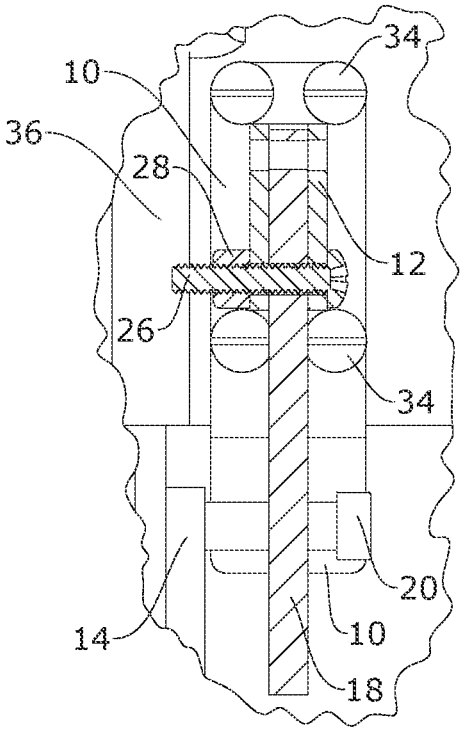
FIG. 11 is a section view of an exemplary embodiment of the present invention, taken along line 11-11 in FIG. 5.

The biased latch hook 18 is biased in a parallel orientation relative to the first piece, illustrated in FIGS. 5 and 7, but is pivotable away from the first piece 36 in a nonparallel orientation, illustrated in FIGS. 6 and 8. A spring 22 operatively associated with a proximal end of the biased latch hook 18 in concert with a pivot point 26 between the proximal end and the distal end of the biased latch hook 18 enables the pivoting and the biasing, respectively.

A mounting plate 10 may be connected to the first piece 36 by way of fasteners 34 and 32. A riser channel 12 may be attached on top of the mounting plate 10 by way of fasteners 24. The riser channel 12 may carry the spring 22 within the channel portion. The flanges of the riser channel 12 may provide aligned holes for receiving the pivot point 26, which may be a threaded fastener) therethrough. Within the channel portion may be a threaded fastener 28 (such as a nut) for securing the pivot point 26 through a pivot hole 41 in the biased latch hook 18.

The mounting plate 10 extends beyond the first piece 36 in general alignment with the proximal end of the biased latch hook 18, though the distal portion 40 of the mounting plate 10 may bend downward toward the second piece 38 in embodiments where the second piece 38 slides into the first piece 36. The distal end of the latch hook 18 may have a tapered edge 48 that mirrors the bent distal portion 40 of the mounting plate 10.

Along the second piece 38, a first fastener plate 14 and a second fastener plate 16 may couple the locking pin 20 by way of sandwiching a fin or rail portion 39 of the second piece 38. Plate fasteners/pins 30 and threaded fasteners 26 and 28 may facilitating such coupling of the first and second fastener plates 14 and 16 to the fin or rail portion 39. The locking pin 20 connects to fastener plate 16, through a threaded connection. In certain embodiments, the fin portion 39 of the second piece 38 may have a complementary receiving portion 37 on the first piece 36, thereby facilitating the proper alignment when moving the two-piece container 50 to its closed position.

In certain embodiments, the mounting plate 10 attaches to a larger end of a Sportube® (the first piece 36). The riser channel 12 is bolted to the mounting plate 10 and contains a hole to hinge the latch hook 18 and a 2nd hole to lock the latch hook 18 in the latched position. The fastener plates 14 and 16 are bolted to the smaller end of a Sportube® (the second piece 38), typically via a fin-portion 39 thereof, such that the latch hook 18 being spring loaded will engage with the steel shoulder bolt 20 when the smaller end is slid into the larger end so that the tapered edge 48 first contacts the shoulder bolt 20 and so that the latch hook 18 is urged upward to the nonparallel orientation until the tapered edge 48 ends, whereby the latch hook 18 is biased so that the hook portion grabs the shoulder bolt 20, securing the Sportube® closed.

The latch hook 18 is spring loaded such that it will hook over the steel shoulder bolt 20 in a locked condition, securing the Sportube® closed preventing loss or damage to the contents. The bent distal portion 40 mounting plate extends past the larger Sportube® end so as to guide the steel shoulder bolt 20 toward the latch hook 18 to guarantee proper engagement. The first fastener plate 14 provides space between the second piece 38 and the shoulder bolt 20, facilitating the distal portion 40 to ride underneath the shoulder bolt 20.

A method of manufacturing the present invention may include the following. The mounting plate 10 may be cut to length from aluminum bar stock 3⁄16" by one inch, then bent as required, four mounting holes then drilled as required, then two holes are drilled and countersunk for attaching the riser channel 12. The riser channel 12 may be cut to length from ½"×¾" aluminum channel stock, then two holes may be drilled through the channel for the hinge and the lock, then two holes may be drilled and tapped to align with the two countersunk holes in the mounting plate 10 and attached with two 10⁄24×¼" flat head screws. Fastener plate 14 may be cut to length from a ¼"×½" aluminum bar stock, then has three holes drilled for attaching to the smaller end of the Sportube® and one hole drilled and tapped to ¼"×20, the two 0.1875 holes each get a 3⁄16"×5⁄8" spring pin installed protruding out the back of the plate and the steel shoulder bolt 20 gets screwed into the front of the ¼"×20 thread, the center of the 3 holes is drilled to 0.205 for 3⁄16 bolt clearance. Fastener plate 16 may be cut to length from ⅛"×½" aluminum bar stock, then three 0.205 holes drilled as required. The latch hook 18 may be cut to length from ¼"×1" aluminum bar stock, then a 5⁄16" hole is drilled as required and 2 3⁄16" holes are drilled as required, using a mill or handsaw cut to shape of the latch hook 18, then drill a hole in the bottom of the latch hook 18 as required for the spring. The latch hook 18 hinge may be a 10-24×1" screw with a nylon locking nut. A 10-24×1" screw with a nylon locking nut is used to attach the bolt plates to the smaller end of the Sportube®. The mounting plate 10 may be located on the Sportube® and four holes are drilled in the larger end of the Sportube® for attachment with Brass binding barrels and screws.

A method of using the present invention may include the following. The self-locking latch assembly 100 disclosed above may be provided and installed on a two-piece container 50, wherein the latch hook 18 is pivotably biased to the first piece 36, and wherein the shoulder bolt 20 is connected to but spaced apart from the second piece. As a result, the latch hook 18 is pivotably between an unlocked condition and a locked condition engaging the shoulder bolt 20 by simply sliding the first piece 36 over the second piece forming a closed position. Thus, the self-locking latch assembly 100 self-locks when the two-piece container 50 is moved to the closed position. The latch hook 18 can be pivoted to a nonparallel orientation to move the self-locking latch assembly 100 to the unlocked condition as the first and second pieces 36 and 38 are moved to an open condition. Additionally, the present invention could be used to automatically latch a sliding door or panel.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. An automatic latch system for a two-piece container slidably movable between a closed position and an open position, the automatic latch system comprising:

a latch hook pivotably biased in a parallel orientation to a first piece of the two-piece container, wherein the first piece has an outer surface that terminates at a peripheral edge, and wherein a distal end of the latch hook projects in a first direction beyond the peripheral edge;

a keeper connected to and spaced apart from a second piece of the two-piece container;

a plate connected to said outer surface, wherein a distal portion of the plate projects in substantially the first direction beyond the peripheral edge, wherein a portion of the leading edge is below the peripheral edge, so that the keeper directly engages with a leading edge the distal portion of the plate as the first and second pieces move toward the closed position; and the distal end of the latch hook has a tapered edge that rides the keeper away from the distal portion of the plate as the first and second pieces move toward the closed position, whereby the keeper is sandwiched between and in direct contact with both the latch hook and said distal portion in the closed position.

2. The automatic latch system of claim 1, further comprising:

a biasing element operatively associated with a proximal end of the latch hook and the first piece; and a pivot point of the latch hook between the biasing element and the distal end of the latch hook.

3. The automatic latch system of claim 2, further comprising:

a riser channel attached to the first piece for carrying the biasing element and the pivot point.

4. The automatic latch system of claim 3, wherein the plate interconnects the first piece and the riser channel.

5. The automatic latch system of claim 3, wherein the plate interconnects the first piece and the riser channel.

6. The automatic latch system of claim 1, wherein a fin portion extends from the second piece, and wherein the keeper is connected directly to the fin portion.

7. The automatic latch system of claim 6, further comprising at least one fastener connecting the keeper to the fin portion.

8. The automatic latch system of claim 1, wherein the keeper is a shoulder bolt.

9. The automatic latch system of claim 5, wherein the keeper rides the distal portion of the plate as the first and second pieces move toward the closed position.

10. A self-locking latch assembly for a container having a first portion and a second portion having a locking condition comprising the first and second portions slidably moving toward each other during a locking condition, the self-locking assembly comprising:

a latch hook pivotably biased relative to a first surface of the first portion, wherein the first surface terminates at a peripheral edge;

a tapered edge of the latch hook disposed beyond the peripheral edge;

a keeper connected to and spaced apart from a second surface of the second portion; and a plate directly connected to said first surface, wherein a leading edge of the plate is disposed beyond the peripheral edge, and wherein a portion of the leading edge is below the first surface so that as the first surface linearly slides toward the second surface in the locking condition the leading edge rides a lower surface of the keeper while the tapered edge rides an upper surface of the keeper.

11. The self-locking latch assembly of claim 10, wherein the tapered edge and the leading edge directly contact the keeper during the locking condition.

12. The self-locking latch assembly of claim 11, wherein in the locking condition the tapered edge is pivoting away from the leading edge.

13. A self-locking latch system comprising:

a two-piece container having a first and second pieces, each piece having a first and second peripheral edge, respectively;

a locking condition of the two-piece container comprising linearly moving the first and second peripheral edges together in a closed position a latch hook pivotably biased to the first piece so that a tapered edge of the latch hook is disposed beyond the first peripheral edge;

a plate connected to the first piece, wherein a leading edge of the plate is disposed beyond the first peripheral edge, and wherein a portion of the leading edge is below the first peripheral edge; and a keeper connected to the second piece so that in the locking condition the keeper slides between the tapering edge and the leading edge.

14. The self-locking latch system of claim 13, urges the leading edge to directly ride a lower surface of the keeper while the tapered edge directly rides an upper surface of the keeper.

15. The self-locking latch system of claim 13, wherein the closed position forms a locked engagement.

16. The self-locking latch system of claim 13, wherein the keeper is spaced apart from the second piece.

17. The self-locking latch system of claim 13, further comprising a fin portion of the second piece; and a may have a receiving portion on the first piece, wherein an aligned condition the fin portion is slidably received by the receiving portion during the locking condition.

18. The self-locking latch system of claim 13, wherein the keeper is connected to the fin portion.

* * * * *